US005674158A

United States Patent [19]

Navas

[11] Patent Number: 5,674,158

[45] Date of Patent: Oct. 7, 1997

[54] EXERCISE BIKE

[76] Inventor: Antonio Guerra Navas, Castillo de Ocio, No. 6, 01007-Vitoria-Gasteiz, Spain

[21] Appl. No.: 580,392

[22] Filed: Dec. 28, 1995

[30] Foreign Application Priority Data

Dec. 29, 1994 [ES] Spain ..... 9402664

[51] Int. Cl.[6] ..... A63B 21/00

[52] U.S. Cl. ..... 482/58; 482/112

[58] Field of Search ..... 482/57, 111, 112, 482/58, 59–63, 113

[56] References Cited

U.S. PATENT DOCUMENTS

| | | | |
|---|---|---|---|
| D. 229,077 | 11/1973 | Scalingi et al. | 482/57 |
| 4,582,318 | 4/1986 | Giannelli et al. | 482/112 |
| 4,645,199 | 2/1987 | Bloemendaal | 482/112 |
| 4,688,791 | 8/1987 | Long | 482/112 |
| 4,720,094 | 1/1988 | Danchulis | 482/57 |
| 4,807,877 | 2/1989 | Baxton | 482/111 |
| 4,884,800 | 12/1989 | Duke | 482/73 |
| 4,979,735 | 12/1990 | Stewart | 482/111 |
| 5,139,255 | 8/1992 | Sollami | 482/58 |
| 5,195,936 | 3/1993 | Mao | 482/112 |
| 5,423,728 | 6/1995 | Goldberg | 482/57 |
| 5,542,507 | 8/1996 | Warchocki et al. | 482/58 |

*Primary Examiner*—Stephen R. Crow
*Attorney, Agent, or Firm*—Rodman & Rodman

[57] ABSTRACT

An exercise bike includes a support structure with a seat, a handle, a pedal assembly and a resistance mechanism that permits regulation of the effort required to actuate the pedals. The resistance mechanism is housed inside a sealed box that defines a chamber. An inertia counterweight disk is disposed inside the sealed chamber, which also contains a liquid or semi-liquid substance. The level of the semi-liquid substance in the chamber may be varied at will to vary the friction force between the disk and the liquid inside the chamber. Thus, the effort required to pedal the exercise bike is correspondingly variable, based on the liquid level in the sealed chamber.

4 Claims, 2 Drawing Sheets

EXERCISE BIKE

This invention refers to an exercise bike, used to pedal without undergoing any movement.

More specifically, the bike of this invention is of the type made up of a supporting structure incorporating a seat, handles and a mechanism that allows the regulation of the amount of effort required to pedal, including at least one inertia disc.

The mechanism used to regulate the amount of pedalling effort required is a friction mechanism of traditional exercise bikes, which may consist of belts that tighten up manually around the inertia counterweight disc. These friction elements may also be made up of rollers that apply pressure upon the inertia disc in order to make it harder to turn. Both elements have a number of inconveniences due to their nature. First of all it is necessary to overcome a great deal of pedal resistance, from the first pedal stroke. Secondly, due to rubbing between the friction elements, there is wear that cause operation to vary after a given pedalling period. It is then necessary to tighten further the friction element in order to maintain constant pull, which makes it necessary to stop pedalling to effect the tightening operation during the performance of the exercise.

The object of this invention is an exercise bike fitted with a friction system that would allow the performance of the exercise with progressive pedalling resistance, proportional to the pedalling rate and, further, that the friction level remain constant throughout the exercise period.

The bike of the invention is characterized by an inertia disc or discs housed in a sealed box or chamber that contains a liquid or semi-liquid substance. The level of the liquid or semi-liquid substance within the chamber may be varied at will.

The variation of the level of the liquid or semi-liquid substance within the chamber allows the user to vary and regulate the friction level between the disc and the liquid or semi-liquid substance and, thus, the effort required to pedal.

The box or chamber will be linked, through a two way pump, to a tank containing the liquid or semi-liquid substance.

According to another aspect of the invention, the bike structure is made up so that the position of its handle and seat may be easily and widely regulated, so that it may be accurately adjusted to the specific wishes or requirements of its user.

For this purpose, the supporting structure includes a tilted frontal guide or track that houses the lower end of two profiles or pillars, which are capable of sliding and of being securely fixed along said track, whereas one of said columns supports the seat and the other one the handle. Furthermore the handle is linked to the corresponding column or profile through an articulated intermediate rotating pin.

Finally, the profiles or columns on which the seat and handle are fitted feature an intermediate articulation that allow them to be folded up, in order to reduce the volume taken up by the exercise bike and thus provide for its easier storage and transportation.

All of the characteristics described above, as well as the advantages derived therefrom, will be shown below in greater detail, aided by the attached drawings, which show an example of the invention.

Figure 1:
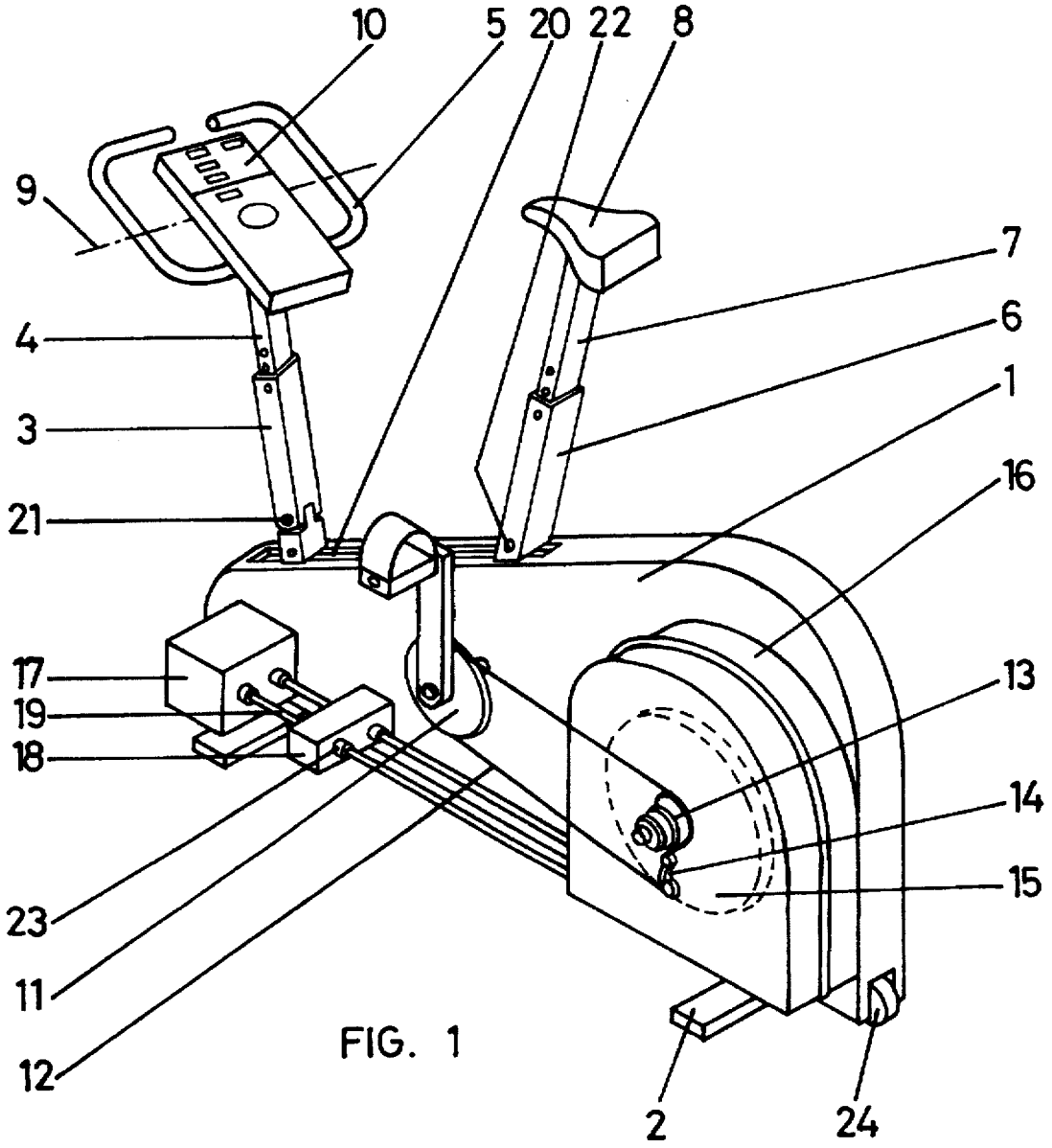
FIG. 1 is a perspective view of an exercise bike built in accordance with the invention.

As may be observed in FIG. 1, the exercise bike of this invention is made up of a basic central body, with reference number 1, preferably a metal structure, welded or assembled with bolts, and fitted with supporting stabilizing feet 2. Said central body 1 is fitted with a telescopic frontal column, made up of adjustable sections 3 and 4, which support handle 5. The central body 1 is furthermore fitted with a rear telescopic column made up of sections 6 and 7, which are adjustable in respect of each other, and which support seat 8.

The sections making up the frontal and rear columns may be made of tubular profiles.

Handle 5 is articulated to upper section 4 of the frontal column through an intermediate articulation pin 9, the handle further carrying computerized cycle 10. The assembly method of handle 5, using the articulation pin 9, allows it to be positioned with different tilt angles.

Figure 2:
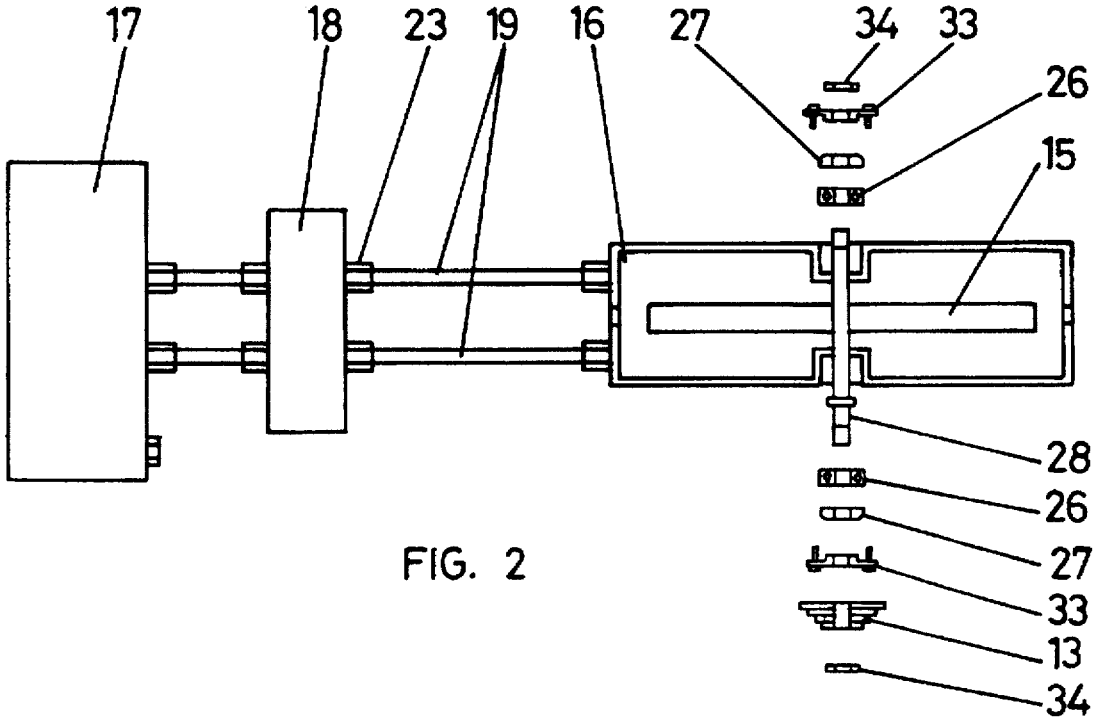
FIG. 2 is a schematic plan view of the friction mechanism, with its various components.

The exercise bike is further complemented with a driving mechanism made up of pedalling assembly 11, transmission chain 12, pinion 13 and gear shift 14, all of this for the actuation of the inertia counterweight disc or discs referenced with number 15 and which, as may be better observed in FIG. 2, is housed within a sealed box 16 or chamber designed to contain a liquid or semi-liquid substance. Said box is connected to a fluid tank 17 through a two way pump 18 and the corresponding communicating conduits 19.

Body 1 may include a casing where chamber 16, tank 17, pump 18 and conduits 18 may be housed.

The body 1 of the exercise bike defines a frontal ramp in which a track 20 has been formed, to which lower sections 3 and 6 of the frontal and rear colunms are attached. Said sections are further fitted with an intermediate articulation, 21 and 22 respectively, that allow the columns to be folded down.

Number 23 indicates the connection adaptors for joining pipes 19 to the chamber 16, pump 18 and tank 17.

Body 1 may be further fitted with auxiliary caster wheels 24 to facilitate its transport.

As may be better observed in FIG. 2, the inertia disc 15 is fully traversed by a shaft 28 fitted onto the walls of the sealed box 16 by way of, for example, the use of bearings 26 and retainers 27 retainer holders 33 and holders 34. Shaft 28 is further joined to pinion assembly 13.

The level reached by the liquid or semi-liquid substance in sealed box 16 may be varied through the use of pump 18 and thus vary the rotation resistance of inertia disc 15, modifying in the same sense the pedalling effort required from the user.

Figure 3:
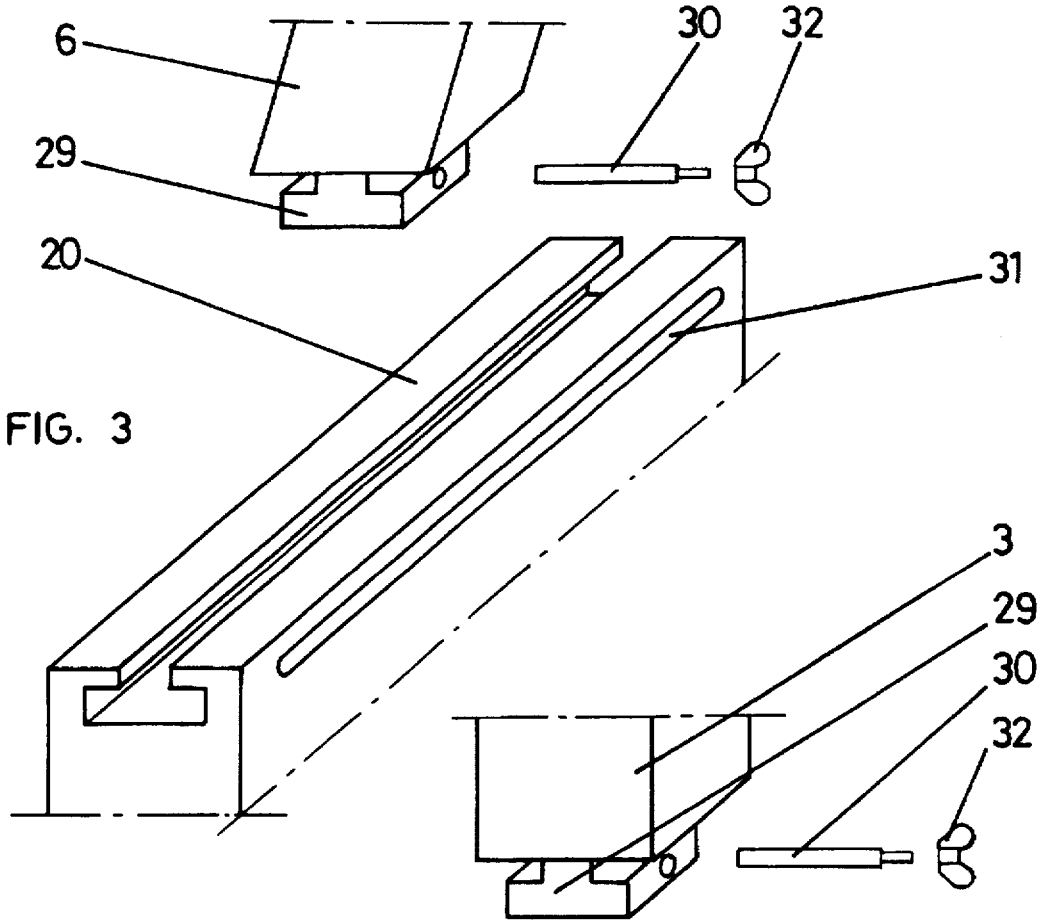
FIG. 3 is a perspective view of the frontal guide and of the lower end of the columns supporting the handle and seat.

FIG. 3 shows the fixing system of the lower sections 3 and 6 of the frontal and rear columns to the guiding track or rail 20. The lower end of sections 3 and 6 are made up of head piece 29 which may be introduced into the guiding track or rail 20 and which is capable of sliding along it. Each one of said head pieces is traversed by a threaded bolt 30 that sticks off the side of guide 20, through longitudinal slot 31, so as to receive a fastening hexagonal or wing nut 32.

By loosening wing nut 32, head piece 29 may be slid along the guiding track or rail 20 until the required position is reached. The wing nut may then be tightened up, being the column then joined to the body 1 of the exercise bike.

The height of the frontal and rear columns may be set at will by changing the magnitude of the sliding joint between sections 3 and 4 or 6 and 7 of said columns.

Finally, whenever it becomes necessary to store or transport the exercise bike, the frontal and rear columns are capable of being folded down through articulated links 21 and 22, respectively.

The articulation system of the handle 5, through pin 9, allows said handle to tilt in either direction up to an angle of 300° approximately.

As already mentioned, even though FIG. 1 represents tank 17, pump 18 and conduit 19, as well as box 16, outside the body 1 of the exercise bike, all of the above components will be housed inside said body, so that an appealing design may be attained.

I claim:

1. An exercise bike comprising a support structure, a seat component, a handle component and a pedal assembly component, each of said components being supported on said support structure, and a resistance mechanism on the support structure for regulating the effort required to rotate the pedal assembly, said resistance mechanism including a sealed box defining a chamber, an inertia counterweight disk disposed in said chamber and being drivingly secured to said pedal assembly, a liquid-based substance provided in said chamber such that the level of the liquid-based substance in said chamber governs the amount of force which must be overcome by the pedal assembly to rotate said inertia disk, and means for varying the level of the liquid-based substance in said chamber to vary the effort required to pedal the exercise bike, and wherein a first column supports the seat and a second column supports the handle, and said support structure includes a tilted guide track which accommodates one end of the first and second support columns, said first and second support columns being slidably arranged in said guide track and lockable in selected positions in said guide track to fix the position of said seat and said handle relative to said guide track.

2. Exercise bike as claimed in claim 1, wherein said means for varying the level of the liquid-based substance inside said chamber includes a two-way pump and a tank containing the liquid-based substance communicable with the chamber of the sealed box, such that actuation of the pump controls the amount of the liquid-based substance flowing from the tank to the chamber and vice-versa.

3. Exercise bike as claimed in claim 1, wherein said first and second support columns include an articulation joint to permit articulation of said first and second support columns with respect to said guide track.

4. Exercise bike as claimed in claim 1, wherein said handle includes an articulation joint to permit rotation of said handle relative to said second support column.

* * * * *